US006666451B2

(12) United States Patent
Leys et al.

(10) Patent No.: US 6,666,451 B2
(45) Date of Patent: Dec. 23, 2003

(54) METHOD AND DEVICE FOR ALIGNING SHEETS

(75) Inventors: Paul Leys, Kontich (BE); Kris Bruyndonckx, Zandhoven (BE)

(73) Assignee: AGFA-Gevaert, Mortsel (BE)

( * ) Notice: Subject to any disclaimer, the term of this patent is extended or adjusted under 35 U.S.C. 154(b) by 0 days.

(21) Appl. No.: 10/219,001

(22) Filed: Aug. 14, 2002

(65) Prior Publication Data

US 2003/0042664 A1 Mar. 6, 2003

Related U.S. Application Data

(60) Provisional application No. 60/345,386, filed on Oct. 26, 2001.

(30) Foreign Application Priority Data

Sep. 3, 2001 (EP) ..... 01000417

(51) Int. Cl.[7] ..... B65H 9/04

(52) U.S. Cl. ..... 271/250; 271/226; 271/234; 271/236; 400/630; 400/633; 399/372

(58) Field of Search ..... 271/226, 234, 271/236, 248, 249, 250, 282, 233; 400/630, 633, 633.1, 633.2; 399/378, 372, 39.5; 101/485, DIG. 36; 198/345.3

(56) References Cited

U.S. PATENT DOCUMENTS 562,797 A * 6/1896 Briggs et al. ..... 271/238
1,014,269 A * 1/1912 Tichborne ..... 271/236
3,754,755 A * 8/1973 Krochert ..... 271/236
3,970,299 A * 7/1976 Berger et al. ..... 271/250
4,986,527 A * 1/1991 Ogoda ..... 271/250
4,997,323 A 3/1991 Giandalia et al.
5,080,345 A * 1/1992 Daniels ..... 271/239
5,215,302 A * 6/1993 Bedzyk ..... 271/239
5,651,540 A 7/1997 Watanabe et al.
5,700,002 A 12/1997 Kato et al.
5,890,713 A 4/1999 Hofmann et al.
5,897,258 A * 4/1999 Wen et al. ..... 400/579
5,967,681 A * 10/1999 Leys et al. ..... 400/636
6,461,065 B2 * 10/2002 Mogi ..... 400/613

FOREIGN PATENT DOCUMENTS

| | | |
|---|---|---|
| DE | 30 02 594 A1 | 8/1980 |
| DE | 198 22 307 A1 | 1/1999 |
| EP | 0 296 816 A1 | 12/1988 |
| EP | 0 846 565 A1 | 6/1998 |
| EP | 01 00 0417 | 1/2002 |
| GB | 2 154 518 A | 9/1985 |

* cited by examiner

*Primary Examiner*—Patrick Mackey
(74) *Attorney, Agent, or Firm*—John A. Merecki; Hoffman, Warnick & D'Alessandro

(57) ABSTRACT

A method and a device for aligning sheets. The device includes a first and a second supporting stop for supporting the sheet against gravity in a first non-aligned position of the sheet. The device further includes two alignment stops and an actuator for moving the sheet from the first non-aligned position to a second aligned position. In the second aligned position, a substantially straight edge of the sheet contacts the two alignment stops and the first supporting stop supports the sheet while the second supporting stop does not support the sheet.

20 Claims, 3 Drawing Sheets

METHOD AND DEVICE FOR ALIGNING SHEETS

The application claims the benefit of U.S. Provisional Application No. 60/345,386 filed Oct. 26, 2001.

FIELD OF THE INVENTION

The present invention relates to a method and a device for aligning sheets. More specifically the invention relates to a method and a device for aligning thermal-sensitive sheets to be used in a thermal printer.

BACKGROUND OF THE INVENTION

Thermal imaging or thermography is a recording process wherein images are generated by the use of thermal energy.

In thermography three approaches are known:

1. Direct thermal formation of a visible image pattern by image-wise heating of a recording material containing matter that by chemical or physical process changes color or optical density.
2. Image-wise transfer of an ingredient necessary for the chemical or physical process bringing about changes in color or optical density to a receptor element containing other of the ingredients necessary for said chemical or physical process followed by uniform heating to bring about said changes in color or optical density.
3. Thermal dye transfer printing wherein a visible image pattern is formed by transfer of a colored species from an imagewise heated donor element onto a receptor element.

Thermographic materials of type 1 can be rendered photothermographic by incorporating a photosensitive agent which after exposure to UV, visible or IR light, e.g. by means of a laser, is capable of catalyzing or participating in a thermographic process bringing about changes in color or optical density.

A survey of direct thermal imaging methods is given in the book "Imaging systems" by Kurt I. Jacobson-Ralph E. Jacobson, The Focal Press—London and New York (1976), Chapter VII under the heading "7.1 Thermography".

Common thermal printers that do no use a laser light source comprise a rotatable drum and an elongate thermal head which is spring-biased towards the drum to firmly line-wise contact a heat-sensitive material which is passed between the head and the drum. The thermal head includes a plurality of heating elements. The image-wise heating of a sheet is performed on a line by line basis, with the heating elements geometrically juxtaposed along each other in a bead-like row running parallel to the axis of the drum. Each of these elements is capable of being energized by heating pulses, the energy of which is controlled in accordance with the required density of the corresponding picture element. The sheet is advanced between the head and the drum by frictional contact of its rear side with the drum.

Patent application EP-A-0 846 565 discloses such a thermal printer having a thermal head.

The images that are printed on such a thermal printer are often used for diagnostic purposes, medical diagnosis in particular. Customarily such images for medical diagnosis are printed on a transparent support. Examples of such images are echograms, CT scans, NMR images. These images are negative-type images, which means that their background is substantially black, the image details having lesser optical densities. FIG. 1 shows two sheets 10 that bear images that are printed by a thermal printer having a thermal head. The image areas E are substantially black and the margins A, B, C and D are transparent. The image cannot be printed on the sheet up to the edge since otherwise the thermal sensitive layer of the sheet would be squeezed at the edge due to the pressure between head and drum, which would soil the thermal head and the transport rollers.

These images are viewed on a light box for diagnosis. On the light box, the images can be positioned so that the transparent margins B are outside of the illuminated area while black screens can be moved in the light box, like curtains, so that they cover the margins C and D. However, if two sheets 10 are positioned alongside each other, as shown in FIG. 1, a transparent area between the two image areas E remains.

Radiologists are unfamiliar with such a transparent area, which does not exist in conventional AgX X-ray images. Moreover, a large transparent area has a dazzling effect. FIG. 1 shows two mammographic images. In mammography, it is customary to view the images of the right and of the left breast on a light box, positioned with respect to each other as shown in FIG. 1 (reference sign 15 in FIG. 1 indicates the contours of the breasts). Both sheets 10 are pushed against each other so that no space is left between them (for clarity, in FIG. 1 an open space is shown between the sheets 10). Thus, a transparent area of twice margin A remains between the images. Up till now, such mammographic images did not have a transparent margin, because they were made e.g. by a conventional AgX apparatus or in a photothermographic printer wherein the laser can expose the sheet up to its edges.

It would be advantageous to print such mammographic images by means of a printer with a thermal head, since this is less expensive than using a photothermographic printer. However, when printed by a conventional printer with a thermal head, on a light box the transparent area between the two images is disturbing.

OBJECTS OF THE INVENTION

It is therefore an object of the invention to provide a thermal printer having a thermal head that can print mammographic images that are suitable for diagnosis on a light box.

It is a further object of the invention to provide a method that allows obtaining, by means of a thermal printer having a thermal head, mammographic images that are suitable for diagnosis on a light box.

SUMMARY OF THE INVENTION AND DEFINITION OF TERMS

The above-mentioned objects are realised by a thermal printer including a device as claimed in claim 1 and claim 5 and by a thermal printer performing a method as claimed in claim 17 and claim 19. The dependent claims set out preferred embodiments of the invention.

A sheet 10 having a substantially straight edge 11, as shown in FIG. 1, is accurately aligned in accordance with the invention. An image can then be printed on the sheet leaving only a small margin A, of e.g. 1.1 mm, between the image area E and the substantially straight edge 11. A transparent area of twice such a small margin A, between two image areas E, is not disturbing when viewed on a light box. Because of the accurate alignment, the margin A has a nearly constant width so that there is no risk of the image area E coming too close to the sheet edge 11, which would result in soiling the thermal head as mentioned above. One margin, margin A in FIG. 1, has a small width; the other margins, margins B, C and D in FIG. 1, may have a larger width.

In a preferred embodiment of the invention, shown in FIG. 2, the substantially straight edge 11 of sheet 10 is aligned with respect to an alignment axis 25 that is substantially perpendicular to the axis 45 of the drum of the thermal printer. Sheet 10 as shown in FIG. 1 may be a substantially rectangular sheet having the standard dimensions of 10"× 12". The image is then printed line-wise with the image lines substantially perpendicular to edge 11, i.e. substantially parallel to edge 12. Preferably, edge 12 is the short, 10", sheet edge and edge 11 is the long, 12", sheet edge. An advantage of this embodiment is that a shorter and hence less expensive thermal head may be used than if the printed image lines would be substantially parallel to the longer sheet edge 11.

In this text, a "substantially straight edge" of a sheet is defined as follows. LS is the straight line segment that is the least squares fit of the edge. An edge is substantially straight if, for all points PT in line segments S belonging to the edge, so that the total length of the line segments S is at least 80% of the length of the edge and preferably at least 90% of the length of the edge, the distance d between PT and LS is d<5 mm, preferably d<3 mm, more preferably d<1 mm and most preferably d<0.5 mm. The distance between points PT and straight least squares segment LS may be larger over portions of the edge (of relative length 20% or 10%) to allow for e.g. notches which are quite customary in medical film sheets.

A first line L1 is "substantially parallel" to a second line L2 if, when L1 is the line parallel to L1 through an arbitrary point O taken as origin and L2* is the line parallel to L2 through O, the smallest angle $\alpha$ between L1* and L2* is a <15°, preferably $\alpha$<10°, more preferably $\alpha$<5°.

A first line L1 is "substantially perpendicular" to a second line L2 if, when L1* is the line parallel to L1 through an arbitrary point O taken as origin and L2 is the line parallel to L2 through O, the smallest angle $\beta$ between L1* and L2* is $\beta$>75°, preferably $\beta$>80°, more preferably $\beta$>85°.

A line is "substantially vertical" if it is substantially parallel to a vertical line; a vertical line has the same direction as the force of gravity.

A "substantially horizontal" line is substantially perpendicular to a vertical line.

A sheet is "substantially rectangular" if it has four substantially straight edges and if the adjoining edges are substantially perpendicular to each other, as defined above.

Further advantages and embodiments of the present invention will become apparent from the following description and drawings.

BRIEF DESCRIPTION OF THE DRAWINGS

The invention is described with reference to the following drawings without the intention to limit the invention thereto, and in which.

DETAILED DESCRIPTION OF THE INVENTION

Figure 2:
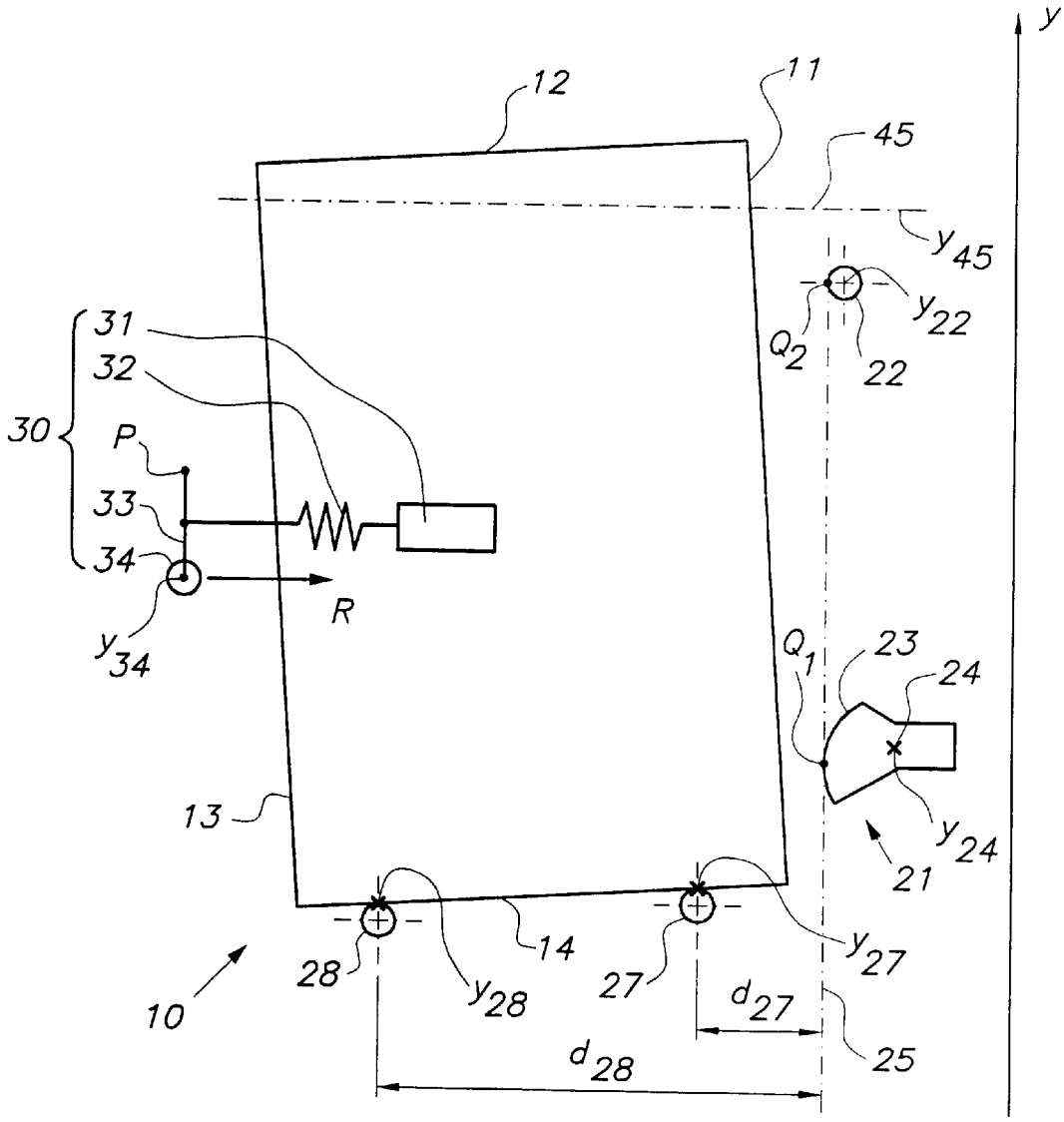
FIG. 2 shows an embodiment of a device according to the invention.

FIG. 2 shows a first embodiment of a device according to the present invention. A sheet 10, which may be fed from a sheet tray in a thermal printer, is dropped onto two supporting stops 27 and 28. The sheet is now in a first, non-aligned position, which is shown in FIG. 2. To accurately align sheet 10, it is moved from this first non-aligned position to a second aligned position (not shown) wherein the substantially straight edge 11 of sheet 10 contacts two alignment stops 21, 22. In the embodiment of FIG. 2, in the second aligned position sheet 10 contacts the alignment stops 21, 22 in points $Q_1$ and $Q_2$. These two points define an alignment axis 25. In the second aligned position, sheet 10 is thus aligned with its substantially straight edge 11 with respect to alignment axis 25.

In order to obtain an accurately defined position of the aligned sheet 10, only one of the two supporting stops 27, 28 supports sheet 10 in its second aligned position. In the embodiment of FIG. 2, sheet 10 contacts in its second aligned position the first and second alignment stops 21, 22 and the first supporting stop 27; it does not contact the second supporting stop 28. Furthermore, sheet 10 makes contact with contact element 34 which pushes sheet 10 against the alignment stops 21, 22. Sheet 10 as shown in FIG. 2 is substantially rectangular. Moreover alignment axis 25 is substantially vertical. The first supporting stop 27 is positioned higher than the second supporting stop 28, i.e. $y_{27}>y_{28}$ wherein $y_{27}$ and $y_{28}$ are the coordinates with respect to vertical axis y of respectively the first alignment stop 27 and the second alignment stop 28. In this way, when sheet 10 contacts the alignment stops 21 and 22, it does not contact the second supporting stop 28.

In a preferred embodiment of the invention, the first supporting stop 27, which supports sheet 10 in its second aligned position, is nearer the alignment axis 25 than the second supporting stop 28, i.e. in FIG. 2 distance $d_{27}<d_{28}$. In this way, the second aligned position is more stable than if $d_{27}>d_{28}$.

Figure 3:
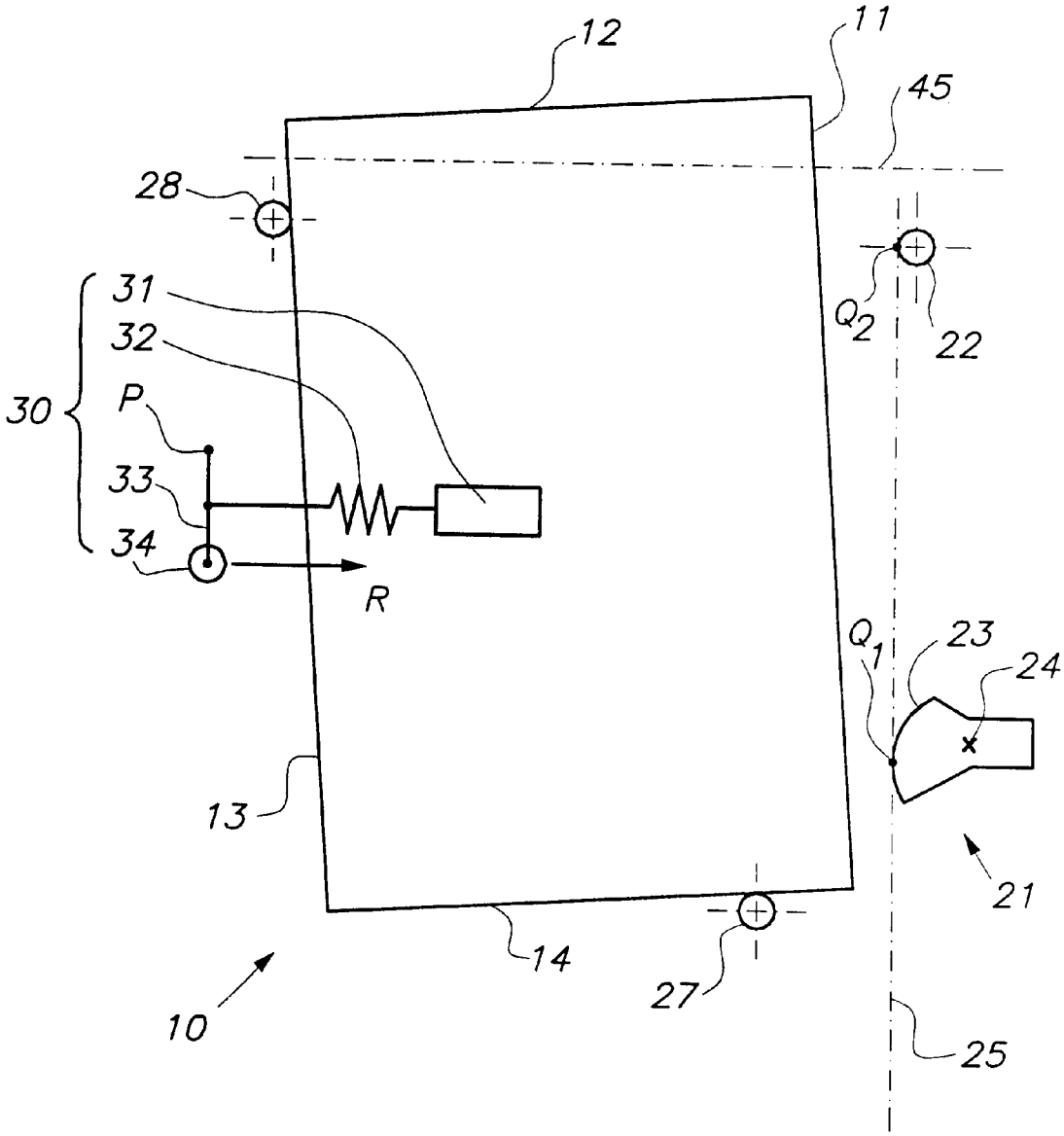
FIG. 3 shows another embodiment of a device according to the invention.

FIG. 3 shows another embodiment in accordance with the invention. Contrary to the embodiment shown in FIG. 2, in the embodiment of FIG. 3 the supporting stops 27 and 28 each contact a different edge of sheet 10 in its first non-aligned position: the 5 first supporting stop 27 contacts edge 14 while the second supporting stop 28 contacts edge 13.

Sheet 10 is moved to its second aligned position by actuator 30. An embodiment of actuator 30 is shown schematically in FIG. 2; it comprises an electromagnet 31, a resilient element 32 such as a spring, a lever 33 that can pivot around point P and a contact element 34 on lever 33. To move sheet 10, electromagnet 31 is energized and pulls lever 33, and contact element 34 on lever 33, in the direction of arrow R. Contact element 34 contacts edge 13 of sheet 10 and pushes sheet 10 against alignment stops 21 and 22. Lever 33 is used to increase the stroke of electromagnet 31. An advantage of resilient element 32 is that a given force is applied to edge 13 without enforcing edge 13 to move over a fixed displacement, which would be the case if the resilient element 32 would be omitted. Enforcing a fixed displacement would cause a deformation of sheet 10 by pressing sheet 10 against alignment stops 21 and 22. Applying the force through resilient element 32 on the other hand gently pushes sheet 10 against the alignment stops 21 and 22. Instead of the actuator 30 shown in FIG. 2, any other actuator as known in the art may be used.

Preferably, before moving sheet 10 against alignment stops 21 and 22, sheet 10 is given a slight touch. This touch may be given by actuator 30. The purpose of this touch is to obtain a good first non-aligned position of sheet 10, since dropping sheet 10 may e.g. have caused the sheet to be not well supported by the supporting stops 27, 28. In the embodiment of FIG. 2, touching the sheet is accomplished by shortly energizing the electromagnet 31 just before the electromagnet 31 is energized again to move the sheet. The complete cycle of touching and moving sheet 10 may be quite short, e.g. less than 1 second.

In a preferred embodiment of the invention, at least one of the alignment stops 21, 22 is adjustable. In the embodiment of FIG. 2, alignment stop 21 is adjustable. Point $Q_1$ is the contact point of alignment stop 21 with sheet 10 in its second aligned position. By rotating alignment stop 21 around its pivot point 24, contact point $Q_1$ moves towards or away from pivot point 24, since arc 23 on which $Q_1$ is located is positioned eccentrically with respect to pivot point 24.

In another embodiment of the invention, the first and second alignment stops 21, 22 are both part of a single element that contacts sheet 10 in its second aligned position by means of these first and second alignment stops 21, 22.

Advantages of a device in accordance with the invention are that it is simple and inexpensive, yet it allows accurate sheet alignment.

After aligning the sheet, an image may be printed on the sheet in a thermal printer having a thermal head. It is preferred, as shown in FIG. 2, that the drum axis 45 of the thermal printer is substantially perpendicular to the alignment axis 25. Printing may proceed as follows. The aligned sheet is seized by a transport mechanism in the thermal printer—the transport system may include the thermal head and the drum. Actuator 30 is now switched off; i.e. in the embodiment of FIG. 2 electromagnet 31 is de-energized so that contact element 34 is withdrawn from sheet 10. The image is printed line-wise, while sheet 10 is advanced between the thermal head and the drum. In the embodiment shown in FIG. 2, the image lines are substantially parallel to edge 12 of sheet 10 (after alignment). The image is printed with a small and nearly constant margin that is adjacent to substantially straight edge 11. Preferably—as shown in FIG. 2, wherein y represents a vertical axis—the alignment axis 25 is substantially vertical and the drum axis 45 is substantially horizontal.

Figure 1:
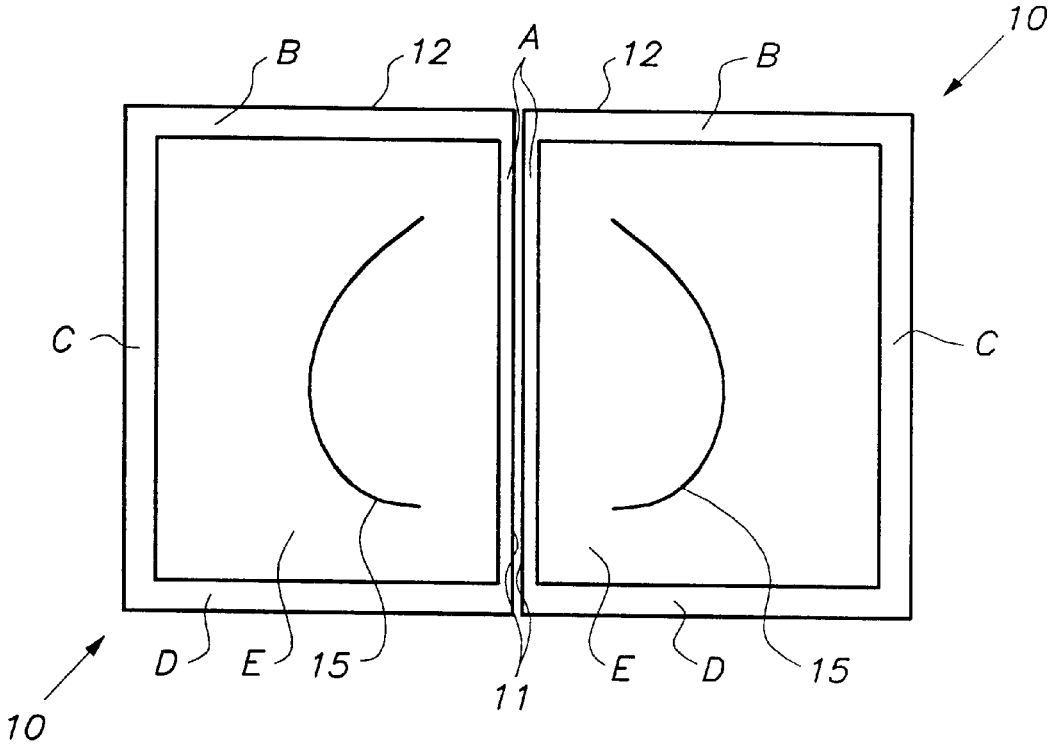
FIG. 1 shows two mammographic images.

To adjust the alignment device, a special test image may be written, preferably in the factory during production of the thermal printer. Using measurements of this test image, the alignment device is then adjusted, e.g. by adjusting alignment stop 21 in FIG. 2. In this way, the small margin of the sheet—i.e. margin A in FIG. 1—will have a nearly constant width. To set the magnitude of the margin width, the position of the thermal head along its axis may be adjusted (the axis of the thermal head is substantially parallel to the drum axis 45).

EXAMPLE

An aligning device as shown in FIG. 2 is used with the following coordinates with respect to axis y:

$y_{28}$=0;

$y_{27}$=0.2 mm;

$y_{24}$=41.6 mm;

$y_{22}$=206.6 mm;

$y_{34}$=131.1 mm;

$y_{45}$=295.4 mm;

and with the following distances:

$d_{27}$=42 mm;

$d_{28}$=214 mm.

Sheet 10 is a thermal-sensitive sheet:

having a support of poly(ethylene terephtalate) with a thickness of 0.18 mm;

having dimensions 302.5 mm (=the length of edges 11 and 13)×252 mm (=the length of edges 12 and 14) and a perpendicularity not larger than 1.5 mm over 300 mm.

Those skilled in the art will appreciate that numerous modifications and variations may be made to the embodiments disclosed above without departing from the scope of the present invention.

LIST OF REFERENCE SIGNS

10 sheet
11, 12 edge
13, 14 edge
15 contour
21, 22 alignment stop
23 arc
24 point
25 alignment axis
27, 28 supporting stop
30 actuator
31 electromagnet
32 resilient element
33 lever
34 contact element
45 drum axis
$d_{27}$, $d_{28}$ distance
y vertical axis
$y_{22}$,$y_{24}$,$y_{27}$,$y_{28}$,$y_{34}$,$y_{45}$ coordinate with respect to y-axis
A,B,C,D margin
E image area
P, $Q_1$, $Q_2$ point
R arrow

What is claimed is:

1. A device for aligning sheets, the sheet having a substantially straight edge, the device comprising:

two alignment stops defining an alignment axis;

a first and a second supporting stop for supporting said sheet against gravity in a first non-aligned position of said sheet;

an actuator for moving said sheet from said first non-aligned position to a second aligned position, said substantially straight edge of said sheet contacting said two alignment stops in said second aligned position;

wherein said first and second supporting stops are positioned so that in said second aligned position said first supporting stop supports said sheet without said second supporting stop supporting said sheet.

2. The device according to claim 1 wherein said first supporting stop is positioned at a smaller distance from said alignment axis than said second supporting stop.

3. The device according to claim 1 wherein at least one of said two alignment stops is adjustable.

4. The device according to claim 1 wherein said actuator comprises a resilient element.

5. A device for aligning sheets, the sheet having a substantially straight edge, the device comprising:

two alignment stops defining an alignment axis;

a first and a second supporting stop for supporting said sheet against gravity in a first non-aligned position of said sheet;

an actuator for moving said sheet from said first non-aligned position to a second aligned position, said substantially straight edge of said sheet contacting said two alignment stops in said second aligned position;

wherein said first supporting stop is positioned at a larger height coordinate with respect to a vertical axis than said second supporting stop.

6. The device according to claim 5 wherein in said second aligned position said first supporting stop supports said sheet without said second supporting stop supporting said sheet.

7. The device according to claim 5 wherein said first supporting stop is positioned at a smaller distance from said alignment axis than said second supporting stop.

8. The device according to claim 5 wherein at least one of said two alignment stops is adjustable.

9. The device according to claim 5 wherein said actuator comprises a resilient element.

10. A thermal printer including a device for aligning sheets, the sheet having a substantially straight edge, the device comprising:

two alignment stops defining an alignment axis;

a first and a second supporting stop for supporting said sheet against gravity in a first non-aligned position of said sheet;

an actuator for moving said sheet from said first non-aligned position to a second aligned position, said substantially straight edge of said sheet contacting said two alignment stops in said second aligned position;

wherein said first and second supporting stops are positioned so that in said second aligned position said first supporting stop supports said sheet without said second supporting stop supporting said sheet.

11. The thermal printer according to claim 10 further comprising:

a thermal head for line-wise printing an image onto said sheet;

a drum for transporting said sheet past said thermal head; wherein said drum has a drum axis substantially perpendicular to said alignment axis.

12. The thermal printer according to claim 11 wherein said thermal head and said drum are positioned for seizing said sheet in said second aligned position.

13. The thermal printer according to claim 10 wherein said first supporting stop is positioned at a smaller distance from said alignment axis than said second supporting stop.

14. The thermal printer according to claim 10 wherein at least one of said two alignment stops is adjustable.

15. The thermal printer according to claim 10 wherein said actuator comprises a resilient element.

16. The thermal printer according to claim 10 wherein said first supporting stop is positioned at a larger height coordinate with respect to a vertical axis than said second supporting stop.

17. A method for aligning a sheet, the method comprising:

dropping said sheet by gravity;

subsequently supporting said sheet by a first and a second supporting stop;

subsequently moving a substantially straight edge of said sheet towards two alignment stops;

subsequently moving said substantially straight edge of said sheet against said two alignment stops, while said first supporting stop supports said sheet without said second supporting stop supporting said sheet.

18. The method according to claim 17 further comprising:

giving said sheet a touch, following said supporting said sheet by said first and said second supporting stop, and preceding said moving said substantially straight edge of said sheet towards said two alignment stops.

19. A method for printing an image on a sheet in a thermal printer, the method comprising:

dropping said sheet by gravity;

subsequently supporting said sheet by a first and a second supporting stop;

subsequently moving a substantially straight edge of said sheet towards two alignment stops;

subsequently moving said substantially straight edge of said sheet against said two alignment stops by a contact element contacting said sheet, while said first supporting stop supports said sheet without said second supporting stop supporting said sheet;

seizing said sheet by a transport mechanism;

withdrawing said contact element from said sheet;

image-wise heating a thermal head so as to write an image on said sheet.

20. The method according to claim 19 further comprising:

giving said sheet a touch, following said supporting said sheet by said first and said second supporting stop, and preceding said moving said substantially straight edge of said sheet towards said two alignment stops.

* * * * *